US006895191B2

(12) United States Patent
Rommelmann et al.

(10) Patent No.: US 6,895,191 B2
(45) Date of Patent: May 17, 2005

(54) INSERTION VERIFICATION OF REPLACEABLE MODULE OF PRINTING APPARATUS

(75) Inventors: Heiko Rommelmann, Penfield, NY (US); Alberto Rodriguez, Webster, NY (US); Neil A. Frankel, Rochester, NY (US); Murray O. Meetze, Jr., Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/436,656

(22) Filed: May 13, 2003

(65) Prior Publication Data

US 2004/0228641 A1 Nov. 18, 2004

(51) Int. Cl.[7] ..... G03G 15/00
(52) U.S. Cl. ..... 399/12
(58) Field of Search ..... 399/12, 13, 24, 399/25, 26, 27, 110, 111

(56) References Cited

U.S. PATENT DOCUMENTS 4,963,939 A * 10/1990 Kurando et al. ..... 399/12
5,678,121 A 10/1997 Meetze, Jr. et al. ..... 399/12
5,999,759 A 12/1999 Palumbo et al. ..... 399/27
6,351,621 B1 * 2/2002 Richards et al. ..... 399/111
6,385,407 B1 * 5/2002 Inose ..... 399/24
6,473,571 B1 * 10/2002 Wegman et al. ..... 399/12
6,532,351 B2 * 3/2003 Richards et al. ..... 399/111
6,711,362 B2 * 3/2004 Asakura ..... 399/12

* cited by examiner

*Primary Examiner*—Sandra L. Brase
(74) *Attorney, Agent, or Firm*—David J. Arthur

(57) ABSTRACT

In a printing apparatus, verification of the correctness of a particular replaceable module takes place before an operating element of the printing apparatus fully engages the replaceable module. A printing apparatus coupler establishes a communication link with a tag on the replaceable module as the replaceable module is being inserted into the printing apparatus. The printing apparatus coupler receives module identifying information from the tag. The coupler determines from the identifying information whether the replaceable module is appropriate for that location in that printing apparatus, and performs either an acceptance action to accept the replaceable module, or a rejection action to reject the module.

8 Claims, 5 Drawing Sheets

INSERTION VERIFICATION OF REPLACEABLE MODULE OF PRINTING APPARATUS

BACKGROUND

The present invention pertains to printing apparatus having replaceable modules, and the replacement of replaceable modules of a printing apparatus. In particular, the present invention pertains to avoiding contamination of or damage to the printing apparatus by verifying the correct identity of a replaceable module before the printing apparatus fully engages the replaceable module.

Many types of printing apparatus, such as office printers and photocopiers, have replaceable modules, such as ink or toner containers, imaging elements, fusers, etc. Some of these modules are designed to be replaced easily by the user, and are sometimes called customer replaceable units (CRU's ). Such customer replaceable units are convenient for machine users. However, inserting an incorrect replaceable module may damage parts of the printing apparatus. For example, inserting into a printing apparatus a toner container having an incorrect toner may cause the printing apparatus to produce poor quality prints, or may even damage components of the printing apparatus.

Physical barriers, such as "keys," are used to block insertion of an incorrect replaceable module. However, depending on the physical structure of the printing apparatus and associated replaceable module, the number of physical "key" combinations may be limited, which limits the number of incorrect replaceable modules that can be reliably excluded.

SUMMARY

In accordance with an aspect of the present invention, a coupler on a printing apparatus communicates with a tag on a replaceable module for a printing apparatus. The tag on the replaceable module stores information concerning the identity of the replaceable module. The printing apparatus coupler reads the information from the replaceable module tag, and determines if the replaceable module is acceptable for use in the printing apparatus. The coupler causes the printing apparatus to automatically take action based on that determination, such that if the replaceable module in not acceptable for use in the printing apparatus, an operating element of the printing apparatus does not fully engage the replaceable module, whereby an unacceptable replaceable module does not contaminate or otherwise damage the operating element of the printing apparatus.

DETAILED DESCRIPTION

Figure 1:
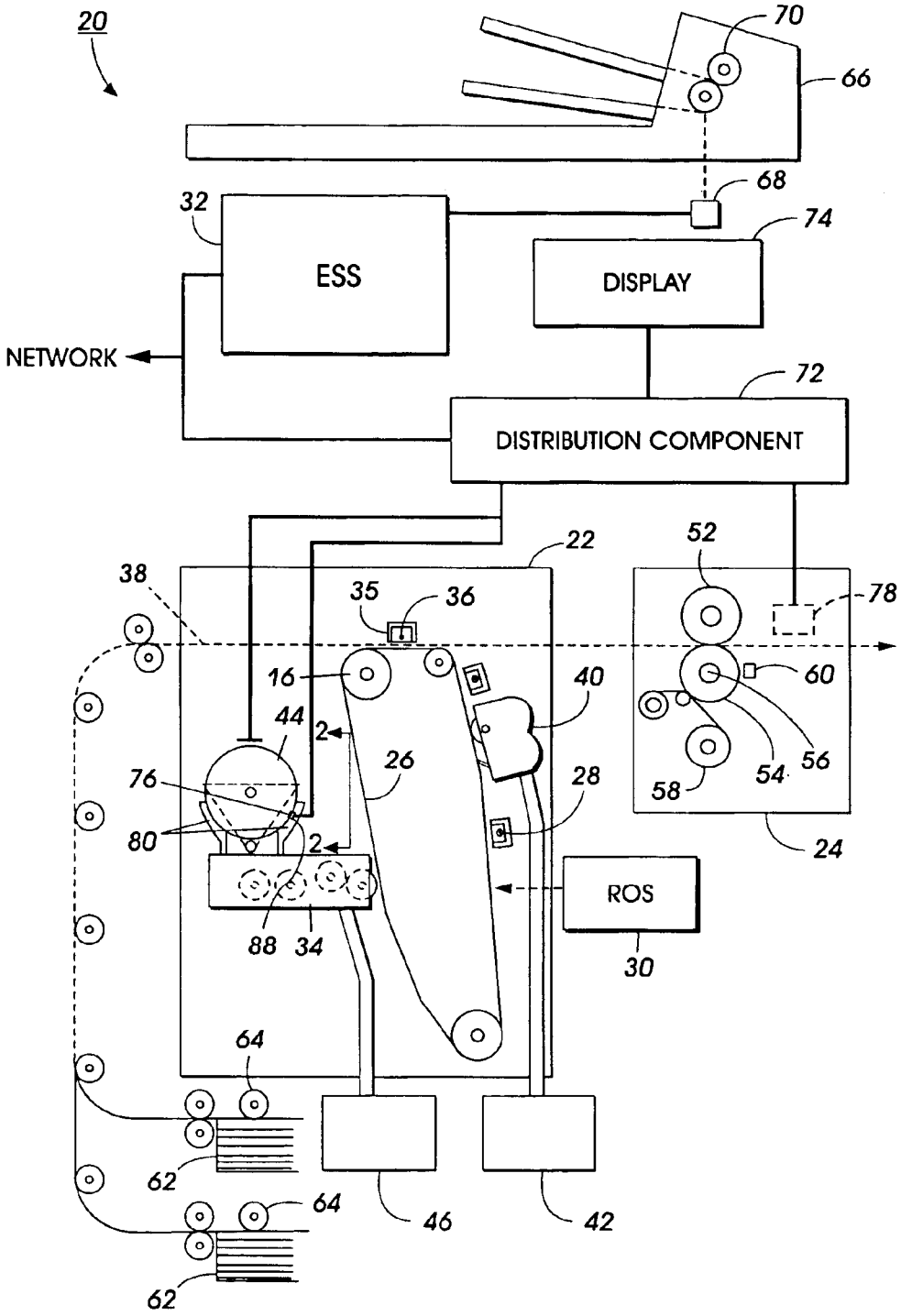
FIG. 1 is a simplified view, partially in elevation, partially schematic, of an electrophotographic printing apparatus in which aspects of the present invention can be embodied.

FIG. 1 is a simplified view, partially in elevation, and partially schematic, of a representative electrophotographic printing apparatus 20, in this case a combination digital copier/printer containing an embodiment of aspects of the present invention. Although embodiments associated with an electrophotographic printing apparatus are described, as used in this document, a "printing apparatus" can apply to any printing apparatus that outputs prints in whatever manner, such as a light-lens copier, digital printer, facsimile, or multifunction device, and can create images electrostatographically, by liquid ink-jet, hot-melt phase change ink jet, or by any other method. An electrophotographic printing apparatus includes a printing subsystem 22 for applying an image to a print media substrate, and a fusing subsystem 24 for fusing the image onto the print media substrate.

The printing subsystem 22 includes printing modules, such as a photoreceptor 26 upon which the image to be printed is formed. The photoreceptor can be a photoreceptor belt as shown, or a photoreceptor drum. The photoreceptor rotates so that a section of the photoreceptor on which images are formed sequentially comes into proximity with other printing modules of the printing subsystem. The other printing modules include a charging corotron 28 for charging the surface of the photoreceptor 26, and a raster output scanner (ROS) imaging element 30 for forming an image in the electrically charged photoreceptor surface. Other apparatus for imagewise discharging of the photoreceptor 26, such as an LED bar or ionographic head, are also known. The image data operative of the ROS 30 or other apparatus typically generated by what is here called an "electronic subsystem" or ESS 32. (For clarity, the necessary connection between the electronic subsystem ESS 32 and the ROS 30 is not shown, but will be apparent to persons skilled in the art.).

A developer unit 34 develops the image on the photoreceptor 26, and a transfer station 35 includes a transfer corotron 36 for transferring the developed image from the photoreceptor 26 to print media substrate as the print media substrate moves along the media path 38. A cleaning device 40 cleans the photoreceptor after the image has been transferred from the photoreceptor to the print media substrate. The cleaning device 40 deposits excess toner into a toner reclaim container 42. Persons skilled in the art will recognize that in any particular embodiment of an electrophotographic printer, there may be variations on this general outline, such as additional corotrons, or cleaning devices, or, in the case of a color printer, multiple developer units.

Persons familiar with the art will recognize that the developer unit 34 generally comprises a housing in which a supply of developer material (which typically contains marking material such as toner particles plus carrier particles) which can be supplied to an electrostatic latent image created on the surface of the photoreceptor or other charge receptor by the ROS. The developer unit 34 may be made integral with, or separable from, other modules of the printing subsystem 22. A printing apparatus capable of printing in multiple colors may have multiple developer units, each developing the photoreceptor with a different primary-color toner. The developer unit 34 receives toner from a toner container 44, which could contain either pure toner or an admixture of carrier particles. Excess developer material is deposited in a developer receptacle 46. In this particular embodiment, the developer receptacle 46 connected to the developer unit and the toner reclaim container 42 connected to the cleaning unit are different receptacles.

The fusing subsystem 24 may include fuser rolls, such as a pressure roll 52, a heat roll 54 including, at the core thereof, a heat element 56, and a web supply 58. The web supply provides a release agent to the outer surface of the heat roll 54 so that media passing between the heat roll 54 and the pressure roll 52 does not stick to the heat roll. Also typically included in a fusing subsystem is a temperature monitor 60, such as a thermistor, for monitoring the temperature of a relevant portion of the fusing subsystem.

Paper or other print media is supplied from media supply trays 62. Paper is drawn from the supply trays, typically one sheet at a time, by feed rollers 64, and transported along the paper path 38, past the image transfer station 35, and through the fusing subsystem 24.

A document handler 66 and a photosensor 68 provide the printing apparatus with copying capability. The document handler 66 presents one or both sides of hard-copy original pages to the photosensor 68. The photosensor creates an electronic image of each hard-copy original page presented to it. An exemplary photosensor is a photosensor bar. One or more lenses (not shown) may focus the image of the original page onto the photosensor. The document handler typically includes rollers 70, nudgers, and other well-understood elements for properly presenting the original page to the photosensor 68.

An information distribution component 72 can send or receive messages, as will be described below, through the same network channels as the electronic subsystem (ESS) 32, or alternatively through a telephone or facsimile line (not shown). Alternatively, the information distribution component 72 can cause messages to be displayed through a display 74, typically in the form of a touch screen disposed on the exterior of the apparatus. In other embodiments, the ESS 32 and the information distribution component 72 may be merged into a single module.

Certain modules in the printing apparatus are typically designed to be replaceable during the lifetime of the printing apparatus. For example, during use, the printing apparatus consumes the marking material contained in the toner container 44. Therefore, the toner container is generally designed to be replaceable by the user of the printing apparatus. Other modules may also be replaceable, either by a user or by a skilled technician. Examples of printing apparatus modules that may be designed to be replaceable include the cleaning unit 40, the transfer corotron 36, and the fusing subsystem 24 (or individual components of the fusing subsystem). In certain printing apparatus, the entire printing subsystem 22, including the photoreceptor 26, the developer unit 34, the toner container 44, the transfer corotron 36, and the cleaning unit 40, is replaceable as a single module.

The information distribution component 72 interacts with specially-adapted "customer replaceable unit monitors" or "CRUMs" 76, 78 that are associated with one or more of the replaceable modules within the printing apparatus. As described more fully in U.S. Pat. No. 6,016,409, the CRUMs contain memory that stores information pertaining to the replaceable module. Each CRUM is capable of communicating with the information distribution component 72 of the printing apparatus at certain times during use of the printing apparatus so that the information distribution component can read information from, and in some cases, write information to, the CRUM for the replaceable module.

In the exemplary embodiments described here, the toner container 44 is a representative replaceable module. However, after reading this description, persons skilled in the art will recognize that the principles can be applied with respect to many replaceable modules of the printing apparatus. In addition to the applicability to different replaceable modules of an electrophotographic printing apparatus, the principles are also applicable to replaceable modules of other types of printing apparatus. For example, in an ink jet printer, the replaceable module may be a container holding ink, either solid ink for a phase change ink jet printing apparatus or liquid ink for a liquid ink printing apparatus. Replaceable modules for an ink jet printer may also include the printhead, a transfer drum, and maintenance elements for the printhead and/or drum.

Figure 2:
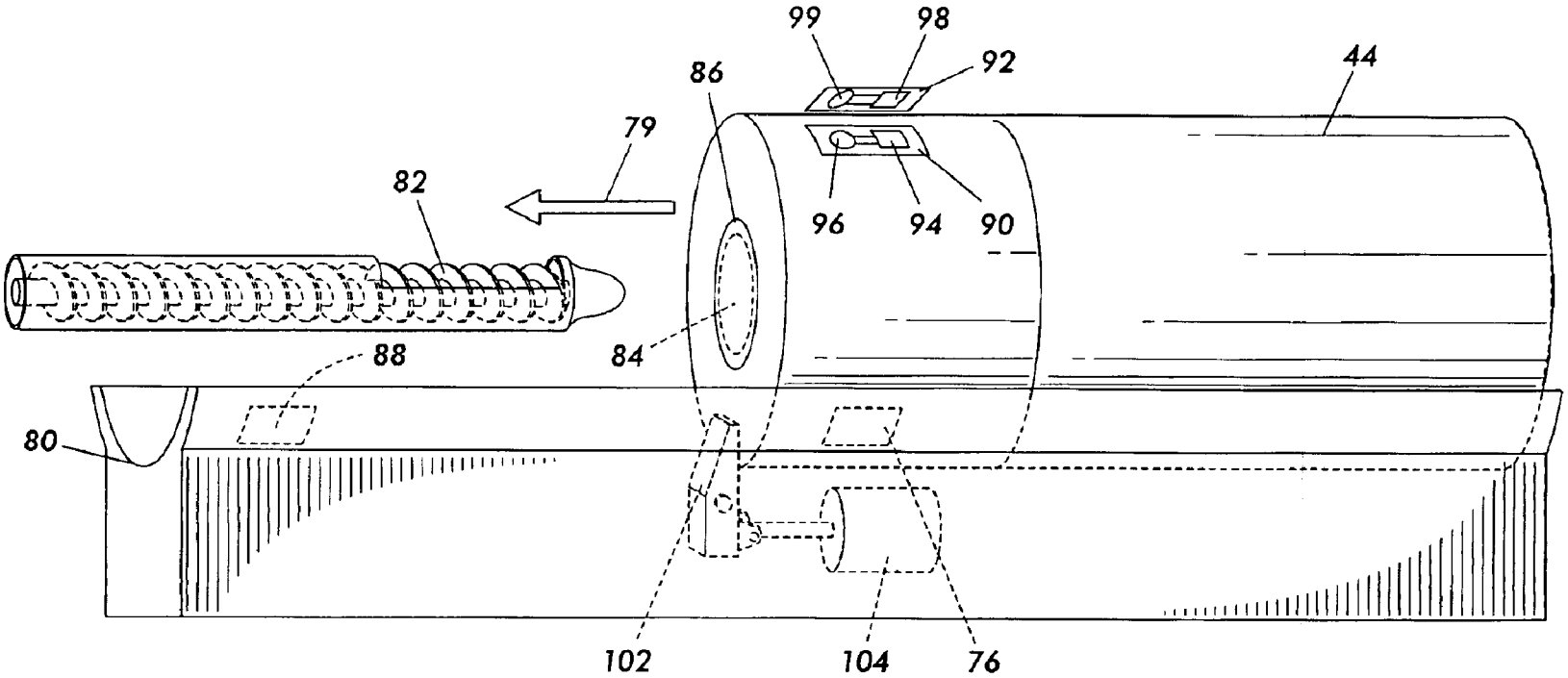
FIG. 2 is a simplified elevational view of one implementation of a replaceable module and a portion of the surrounding structure of the printing apparatus of FIG. 1, taken along line 2—2 of FIG. 1.
Figure 3:
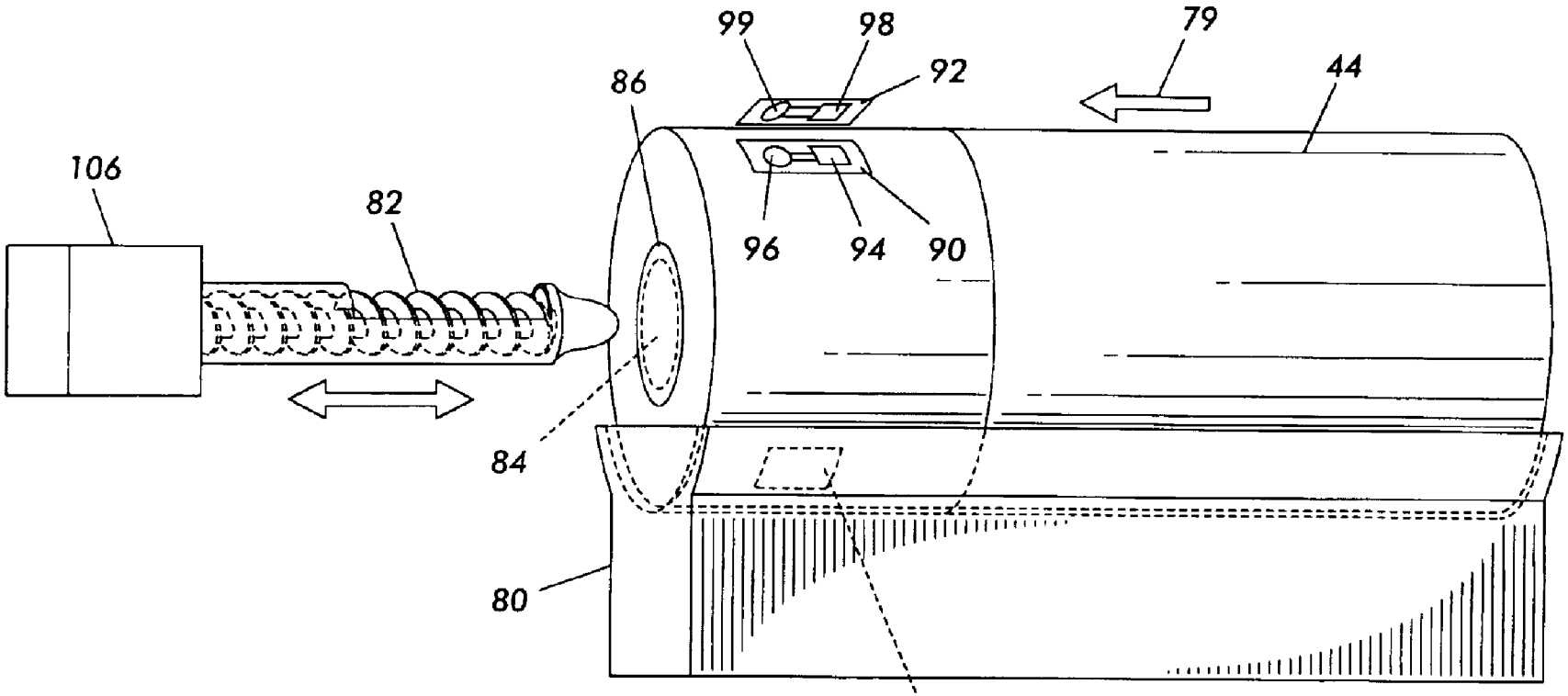
FIG. 3 is a simplified elevational view of an alternative implementation of a replaceable module and surrounding structure of the printing apparatus of FIG. 1.

FIGS. 2 and 3 show two exemplary embodiments using one particular type of toner container replaceable module 44. The illustrated toner container is substantially cylindrical, with a longitudinal axis. The toner container is inserted into the printing apparatus along an insertion path 79 that is substantially aligned with the longitudinal axis of the cylindrical toner container, and may be defined by an insertion guide 80 forming a part of the printing apparatus. After insertion, the toner container rests on a holder, such as a cradle formed of the terminal portion of the insertion guide 80. When inserted into the printing apparatus, the toner container engages an operating element of the printing apparatus, in this case an auger 82 for drawing toner from the toner container for use in the developer of the printing apparatus. One end of the toner container has an access opening 84 through which the auger 82 can be inserted into the toner container. A seal 86 covers the toner container access opening 84 to hold the toner inside the toner container until the toner container fully engages the printing apparatus. The seal 86 is fracturable so that the end of the auger 82 can pierce the seal and enter the interior of the toner container.

After studying this disclosure, persons skilled in the art will recognize that the principles represented can be applied to replaceable modules having other shapes and other mechanisms of engagement with the printing apparatus. For other types of replaceable modules, other arrangements may constitute engagement between the printing apparatus and the replaceable module. For example, some types of modules, full engagement is established by applying an electrical voltage or signal to the replaceable module. Such modules may be in physical contact, but not fully engaged until such voltage or signal is applied.

When the replaceable module toner container is fully inserted into the printing apparatus, the CRUM 76 on the replaceable module engages a CRUM reader 88 on the printing apparatus. The CRUM reader 88 communicates with the CRUM 76 to read certain information from the CRUM concerning the status of the toner container, and to write to the CRUM certain information concerning use of the toner container in the printing apparatus. Communication between the CRUM 76 and the CRUM reader 88 may be a wired communication contact, or a wireless communication link. The CRUM reader 88 forms part of the distribution component 72 of the printing apparatus (FIG. 1). Persons skilled in the art are familiar with such CRUMs, their construction, and their use.

The replaceable module 44 contains a tag 90 for communicating with a coupler 92 in the printing apparatus as the replaceable module moves along the insertion path, before the replaceable module fully engages the printing apparatus. In the exemplary embodiment, the tag 90 communicates with the coupler 92 before the operating element (the auger 82) engages the toner inside in the toner container 44. Although an exemplary embodiment is shown in which the tag 90 and the CRUM 76 are separate, the tag may be part of the customer replaceable unit monitor (CRUM) 76 that contains information pertaining to various monitoring functions such as tracking usage of the replaceable module. An exemplary CRUM into which the tag can be incorporated is described in U.S. Pat. No. 6,532,351, entitled Wireless Interaction With Memory Associated With a Replaceable Module for Office Equipment, by inventors Austin Richards and Michael Thomson.

The tag 90 on the replaceable module includes a tag memory element 94 for storing information relevant to identifying the replaceable module, such as model information, regional usage information, or a serial number. The tag memory element 94 may be a separate EEPROM or other conventional memory device attached to the replaceable module. In an embodiment in which the tag 90 is a portion of the CRUM 76, the tag memory element may be a portion of the memory of the CRUM. The tag also contains a tag communication element 96 for communicating with the printing apparatus coupler 92.

The printing apparatus coupler 92 includes a coupler processor element 98 and a coupler communication element 99 connected to one another. The coupler processor 98 may be either a dedicated processor for the coupler (as shown), or it may be a programmed function within the general processor for the printing apparatus. In certain implementations, the coupler processor 98 could be a simple "compare" circuit for comparing one set of data with another set of data, whether stored in the coupler or received from an external source. The coupler 92 draws operating electrical power from the printing apparatus.

The coupler communication element 99 and tag communication element 96 are capable of forming a communication link between the coupler 92 and the tag 90. The coupler communication element 99 is capable of transferring queries from the coupler processor 98 to the tag communication element 96. The tag communication element 96 receives the queries from the coupler communication element, transfers the query to the tag memory element 94, and transmits a response from the tag memory element to the coupler communication element 99. The coupler communication element 99 also receives the responses from the tag communication element 96, and transfers those received responses to the coupler processor 98.

The communication link formed between the coupler communication element 99 and the tag communication element 96 may be either a wireless communication link or a wired communication link. For a wireless communication link, the coupler communication element and the tag communication element are matched wireless transceivers that enable the coupler communication element to transmit queries to the tag communication element. In exemplary embodiments, the tag communication element 96 is a passive transceiver, so that the tag 92 does not require its own power source.

A wireless communication link can be, for example, a radio frequency (RF) link, an infrared link, or a magnetic link. For an exemplary radio frequency communication link such as shown schematically in FIGS. 2 and 3, the coupler communication element 99 includes an RF antenna for transmitting and receiving radio frequency signals. The tag communication element 96 also includes a RF antenna. The tag communication element may contain passive RF structures that obtain any needed transmission energy from received RF signals. Thus, the tag on the replaceable module need not include a separate power source. Persons skilled in the art will be familiar with such passive RF structures.

The coupler 92 can then issue a query through the coupler RF antenna 99. When the tag RF antenna 96 is within range of the coupler RF antenna, a communication link is formed between the coupler and the tag so that the coupler and the tag can communicate with one another. Once the communication link is established, the tag can receive the query. The RF communication element of the tag 99 retransmits from the tag specified information from the tag memory element 94 in response to the query received from the coupler.

The coupler 92 is positioned on the printing apparatus, and the tag 90 is positioned on the replaceable module, so that the coupler and tag establish such a communication link before the replaceable module to which the tag is attached fully engages the printing apparatus. The replaceable module fully engages the printing apparatus when the replaceable module is inserted into the printing apparatus to such a position that, if the replaceable module were improper, the replaceable module (or the contents of the replaceable module) could contaminate or otherwise damage the printing apparatus. Positioning of the coupler and the tag so they communicate with one another before the replaceable module is in a position to contaminate or otherwise damage the printing apparatus allows corrective action to occur to prevent such contamination or other damage if the user attempts to insert an incorrect replaceable module. In particular, if the replaceable module is a toner container, the coupler and the tag are positioned so that communication between them before an operating element of the printing apparatus (such as the auger 82 or other content removal tool) contacts the toner in the container. In an exemplary implementation in which the replaceable module 44 is inserted into the printing apparatus along the insertion path 79, the coupler and the tag are positioned so that the communication link is established as the replaceable module moves along the insertion path.

Once the communication link between the printing apparatus coupler and the replaceable module tag is established, the coupler communicates a query to the tag seeking, for example, identifying information. The tag responds with responding information, such as its identifying information stored in the tag memory. The coupler processor analyzes the information received from the tag. The coupler processor determines if the received tag identifying information indicates that the replaceable module is acceptable for the printing apparatus, or unacceptable.

An acceptable toner container, for example, would have the proper type of toner for that particular printing apparatus. A color printing apparatus that uses multiple toner containers, each having a different color, may have a separate coupler positioned along each insertion path for the toner containers of the different color toners to guard against inserting an incorrect color toner.

After receiving and analyzing the response information from the tag, the coupler processor 98 causes the printing apparatus to take action based on whether the replaceable module is acceptable or unacceptable. In one example, the printing apparatus can take acceptance action if the coupler processor determines that the tag information indicates the replaceable module is acceptable.

Printing apparatus acceptance action may include removing a barrier that would otherwise block full insertion of the replaceable module into the printing apparatus, or displaying on a user interface (such as a control panel screen) an instruction for the user to continue inserting the replaceable module into the printing apparatus. Such acceptance action may include causing the printing apparatus to fully engage the replaceable module, such as by inserting an auger into the toner container, or causing electrical operating contacts to engage the replaceable module, or applying particular operating voltages or electrical signals to the replaceable module.

FIG. 2 illustrates an embodiment in which as the toner container moves along the insertion path in the insertion direction, a moveable barrier 102 blocks further movement at an insertion checkpoint. When the toner container is at the insertion checkpoint, the replaceable module tag 90 and the printing apparatus coupler 92 are in proximity with one another so that the coupler can form a communication link between the coupler communication element 98 and the tag communication element 96. The coupler determines whether the toner container is appropriate for the particular position of the particular printing apparatus. If the container is appropriate, the coupler initiates an acceptance action by causing a barrier control element 104 to remove the barrier 102. In an exemplary embodiment, the barrier control element 104 is a solenoid that when activated rotates the barrier 102 out of the toner container insertion path. Once the barrier 102 is removed, the user can continue to move the toner container along the insertion path. The acceptance action may include displaying an acceptance message on the display 74 (FIG. 1). Such an acceptance message may include instructions for the user to continue or resume moving the toner container along the insertion path. As the toner container moves further along the insertion path, the end of the auger 82 pierces the container access opening seal 86, and the auger enters the interior of the toner container so that the printing apparatus fully engages the toner container replaceable module. When the toner container is fully inserted into the printing apparatus, the CRUM 76 on the toner container is proximate the CRUM reader 88 so that the CRUM reader can communicate with the CRUM. Persons skilled in the art are familiar with various mechanisms for communication between the CRUM reader and the CRUM. If the coupler determines that the toner container is inappropriate for that particular position of that printing apparatus, the barrier control 104 maintains the barrier 102 in the insertion path, preventing further movement of the toner container along the insertion path past the insertion checkpoint. The printing apparatus then does not fully engage the replaceable module, as the auger does not contact the inappropriate toner. The barrier thus prevents contamination of the auger by inappropriate toner.

FIG. 3 illustrates an embodiment in which the physical movement of the toner container 44 along the insertion path 79 ends when the end of the toner container encounters a fixed barrier, such as the end of the cradle 80. When the toner container is adjacent the barrier, the replaceable module tag 90 is in proximity with the coupler 92 so that the coupler can form a communication link between the coupler and the tag. The coupler determines whether the toner container is appropriate for the particular printing apparatus. If the container is appropriate, the coupler initiates an acceptance action that causes an operating element of the printing apparatus and the replaceable module toner container to engage one another. The coupler causes a motor 106 or other propulsion element to move the operating element of the printing apparatus, in this case the auger 82, to complete the insertion path and fully engage the replaceable module. The motor 106 moves the auger 82 longitudinally toward the toner container. The end of the auger pierces the seal on the end of the toner container so that the auger contacts the toner inside the toner container and the printing apparatus fully engages the toner container replaceable module. The printing apparatus CRUM reader 88 and the replaceable module CRUM 76 are positioned so that they are also able to establish a communication link. As noted above, the tag 90 and the CRUM 76 may be formed in the same structure, and the coupler 92 and the CRUM reader 88 may similarly be embodied in the same structure.

In other examples, the printing apparatus can take exception action if the coupler processor determines that the tag information indicates the replacement module is unacceptable. Such exception action may include displaying a warning on a user interface (such as the display 74), or inserting a barrier that blocks engagement of the replaceable module and the printing apparatus. For example, the normal position of the moveable barrier 102 of the embodiment shown in FIG. 2 may be out of the insertion path for the toner container. As the toner container moves along the insertion path past the insertion checkpoint, the coupler 92 establishes the communication link with the tag 90 on the toner container. If the coupler determines that the container is appropriate for that position of that printing apparatus, the barrier 102 remains out of the insertion path. However, if the coupler determines that the container is inappropriate, the coupler may cause the barrier control element 104 to move the barrier 102 into the insertion path, so that the barrier blocks further movement of the toner container along the insertion path.

In some instances, the coupler processor 98 may not be able to determine conclusively whether the replaceable module is acceptable or unacceptable. The coupler processor may determine from the tag identifying information that the replaceable module may be acceptable in certain applications, and not in others, which would require that the user determine which application is pertinent. Or, the coupler processor may determine that the replaceable module is acceptable with a caveat (such as use of that particular replaceable module may void the warranty on the printing apparatus, or that print quality may change). In such instances, the printing apparatus may take exception action that includes displaying a comment for the user to acknowledge prior to completing insertion of the replaceable module.

In certain embodiments, the communication link between the coupler 92 and the tag 90 may be infrared radiation. In such an embodiment, the coupler communication element 99 may comprise an infrared emitter and an infrared detector. The tag communication element 96 may similarly comprise an infrared detector and an infrared emitter. Or, in an alternative, the tag memory 94 and the tag communication element may be formed of a single infrared reflector that reflects a pattern comprising the module identifying information.

In other embodiments the coupler communication element and the tag communication element may physically contact one another to establish the communication link between the printing apparatus coupler and the replaceable module tag. Such physical contact communication elements are also positioned so that the communication link is established before the replaceable module fully engages the printing apparatus. Persons skilled in the art will recognize that many different types of connectors are available for such physical contact. Different types of connectors are appropriate depending on whether the communication link is to be established while the replaceable module moves along the insertion path, or while the replaceable module is stationary with respect to the printing apparatus. One example of physical connectors includes incorporating an electrically conductive pad for one communication element, and an electrically conductive brush for the other communication element. Another example incorporates an electrically conductive pad for one communication element, and an electrically conductive roller for the other communication element. Yet another example incorporates an electrically conductive slot and an electrically conductive pin that fits into the slot.

Figure 4:
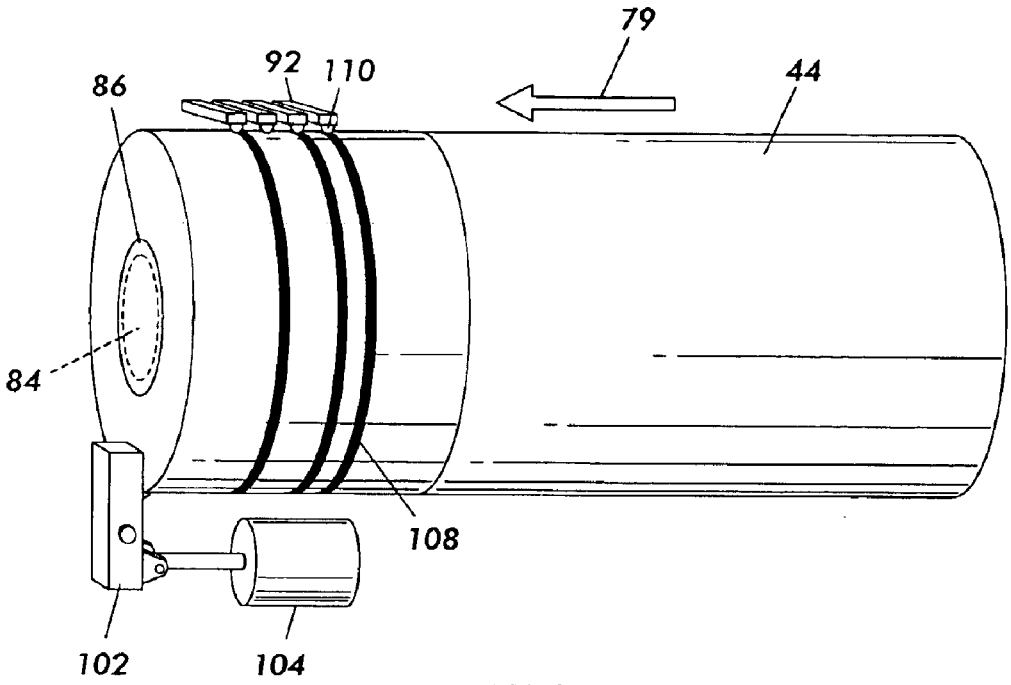
FIG. 4 is a simplified elevational view of another alternative implementation of a replaceable module and certain other elements of the printing apparatus of FIG. 1.

FIG. 4 illustrates an embodiment in which a single set of contact elements forms both the tag memory element and tag communication element. Contact elements formed of conductive strips 108 on the exterior of the toner container form tag memory that contain identifying information concerning the toner container. Each different type of toner container has a unique combination of conductive strips arranged in a particular pattern, such as at particular longitudinal locations. The conductive strips 108 are exposed for physical contact so that the conductive strips also form the tag communication element. In particular, the conductive strips may be raised with respect to the external surface of the toner container. The coupler communication element is an array of coupler contacts 110 at longitudinal locations that coincide with the locations of the conductive strips 108 on a toner container if the toner container is appropriate for that particular position of that particular printing apparatus. When the toner container is at the insertion checkpoint, the coupler contacts engage the conductive strips to establish a communication link between the conductive strips and the coupler. The coupler processor of the coupler 92 may be a simple switch array that completes an electrical circuit if the coupler contacts 110 contact the correct combination of conductive strips 108. The completed circuit activates the barrier control solenoid 104 to move the moveable barrier 102 and allow the toner container to continue moving along the insertion path to be engaged by the printing apparatus. With the conductive strips 108 continuous around the perimeter of the toner container, the coupler is able to establish contact regardless of the rotational position of the cylindrical toner container. The conductive strips can alternatively encompass only a portion of the circumference of the toner container. In yet another alternative, the conductive strips may be longitudinally aligned along the surface of the toner container.

Figure 5:
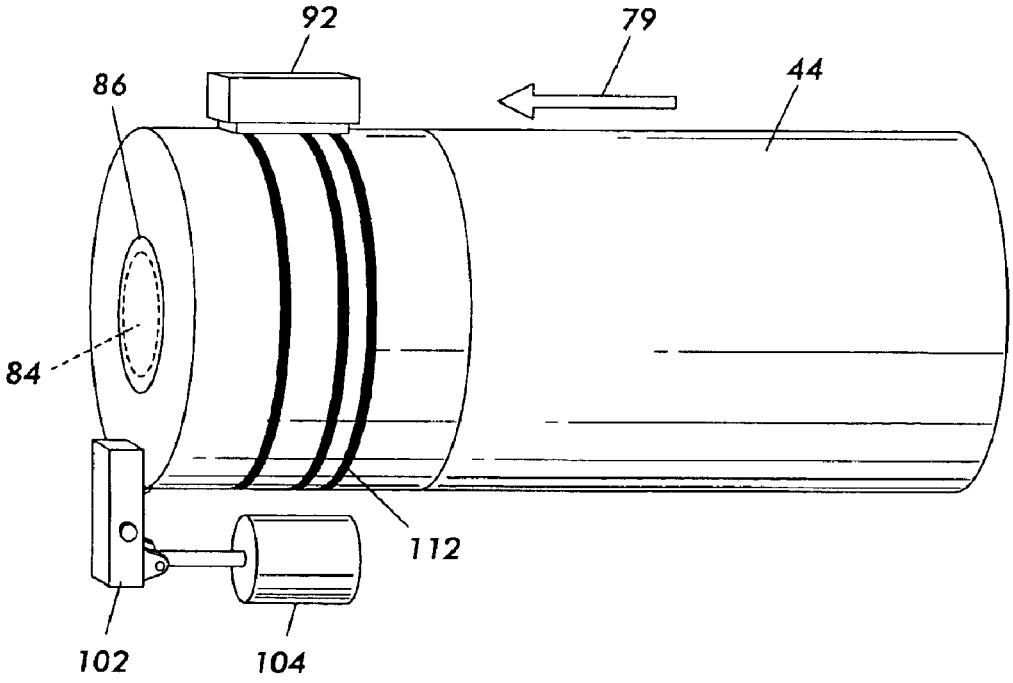
FIG. 5 is a simplified elevational view of yet another alternative implementation of a replaceable module and certain other elements of the printing apparatus of FIG. 1.

FIG. 5 illustrates an embodiment in which the coupler 92 includes a bar code reader, and the toner container has a tag formed of printed rings 112 printed on the perimeter of the toner container in a bar code pattern. Each type of toner container has its unique bar code pattern, so that the bar code identifies a particular type of toner container, thereby storing identifying information. Various types of bar code scanners are widely known. The bar code scanner of the coupler includes a light source (not shown) that emits light toward where the bar code on the toner container is expected to be when the toner container is at the insertion checkpoint. The bar code communicates with the bar code reader by reflecting light incident from the bar code scanner light source. The bar code scanner also includes a detector (not shown) that detects light reflected by the toner container bar code. When the toner container is at the insertion checkpoint along the insertion path, the bar code scanner emits light toward the toner container, and the printed bar code reflects a pattern of light toward the detector of the coupler to establish a communication link between the coupler bar code scanner and the printed bar code tag on, the toner container. The coupler processor (not shown in FIG. 5) in the coupler 92 decodes the bar code pattern detected by the detector to determine if the toner container is appropriate for that particular position in that particular printer. If the coupler determines that the toner container is appropriate, the coupler causes an acceptance action, such as causing a solenoid or other barrier controller 104 to move the barrier 102 from the insertion path. A bar code tag comprising printed rings 112 applied to the entire circumference of the toner container allows the coupler bar code reader to read the bar code tag regardless of the rotational orientation of the toner container. The bar code tag may alternatively be applied to only a segment of the circumference of the toner container.

The replaceable module tag and the printing apparatus coupler can be placed in other positions that allow for the coupler to read identifying information from the replaceable module before an operating element of the printing apparatus fully engages the replaceable module.

Figure 6:
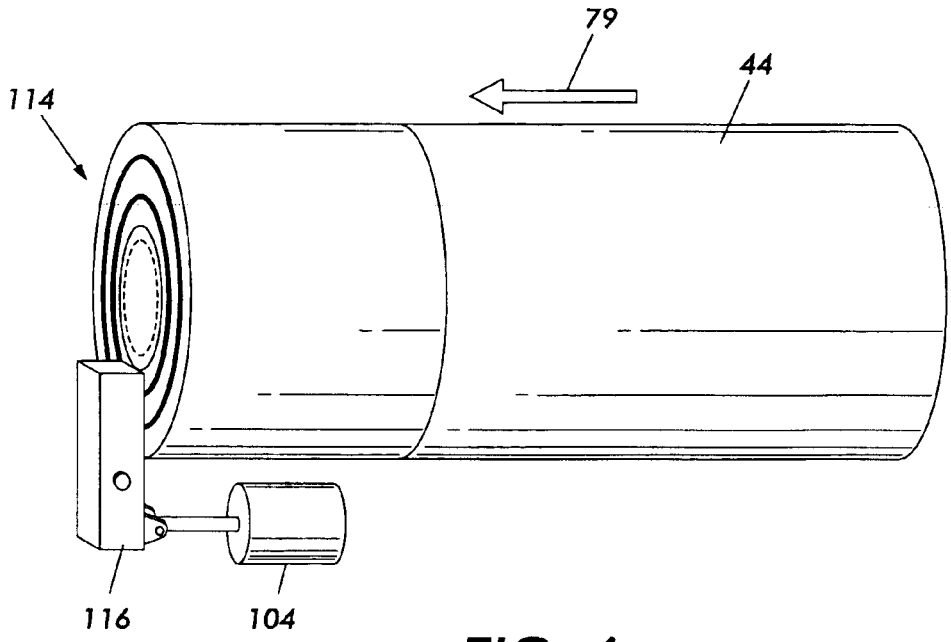
FIG. 6 is a simplified elevational view of a further alternative implementation of a replaceable module and certain other elements of the printing apparatus of FIG. 1.

FIG. 6 illustrates an embodiment in which the replaceable module tag is applied to an end surface of a cylindrical toner container. The tag may comprise a plurality of contact elements, such as conductive strips 114. The coupler is arranged to read the contact elements on the end surface of the toner container. For example, the coupler may be integrated with the movable barrier 116 that blocks module insertion path. The coupler may comprise coupler contacts located to contact the conductive strips. Each type of toner container bears a unique arrangement of conductive strips. For rotational independence, the conductive strips may be arranged to form concentric rings. The coupler 116 may further include a processor to determine if the conductive strips 114 the coupler contacts contact form the pattern that identifies a toner container that is appropriate for that particular position in that particular printing apparatus. An alternative to the conductive strips contacted by coupler contacts, the coupler 116 may be a bar code reader, and the strips 114 of the tag a bar code printed on the end of the toner container.

Figure 7:
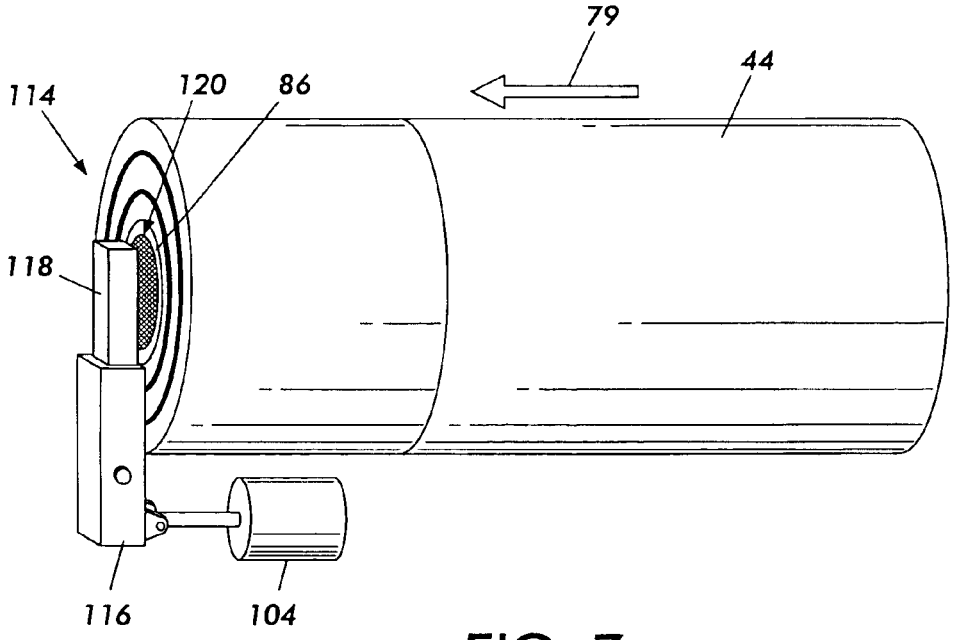
FIG. 7 is a simplified elevational view of an alternative implementation of a replaceable module and certain other elements of the printing apparatus of FIG. 1.

FIG. 7 shows yet another embodiment that incorporates additional capabilities. The embodiment shown in FIG. 7 is a modification of the embodiment of FIG. 6, adding an encrypted hologram reader 118 to the coupler 116. The tag includes both strips 114 in an identifying pattern, and a hologram 120 on the toner container. The communication link between the coupler and the tag includes the hologram reader 118 detecting image information reflected from the hologram 120. The coupler processor can then determine from the image information in conjunction with the identifying information from the conductive strips or bar code whether the toner container is appropriate. In alternative embodiments, the hologram reader may be used without the illustrated coupler contacts or bar code reader, so that the coupler obtains all of its identifying information from the hologram 120. In a particular embodiment, the hologram is applied to the container access opening seal 86. If the toner container is removed from the printing apparatus, refilled with different toner, and reinserted, the coupler identifies the container as appropriate only if a new container access opening seal is applied identifying the contents of the toner container as appropriate for that the particular position in the particular printing apparatus.

While particular embodiments exemplary of the invention have been described in detail, after reading the above descriptions, persons skilled in the art will be able to develop readily various modifications to the specific embodiments described, without departing from the spirit of the invention. For example, the principles of the invention can be applied to toner containers or other replaceable modules that are not cylindrical. The details of the positioning of the coupler, the tag, and the communication link between the coupler and the tag depend on the physical configuration of the replaceable module. Furthermore, the principles can be applied to various other types of replaceable modules, such as fusers, imaging elements (photoreceptor drum), cleaner elements, integrated print cartridges that incorporate multiple elements in a single module. In addition, the principles described can also be applied to replaceable modules of printing apparatus that use printing techniques other than electrostatic imaging, such as ink containers for solid or liquid ink printers, ink jet printhead maintenance stations, etc. Therefore, the invention should not be construed as limited to the particular embodiments described.

We claim:

1. A method of verifying a replaceable module for a printing apparatus having a coupler, the method comprising:

placing the replaceable module in proximity with a coupler attached to the printing apparatus;

electrically reading with the coupler module information from the replaceable module;

determining if the read module information is in a permitted category or in a prohibited category;

automatically causing the printing apparatus to be placed in an engaging condition if the read module information is in the permitted category; and automatically causing the printing apparatus to be placed in a non-engaging condition if the read module information is in the prohibited category;

wherein automatically causing the printing apparatus to be placed in an engaging condition comprises automatically displaying a user instruction to proceed with engaging the replaceable module and an operating element of the printing apparatus; and wherein automatically causing the printing apparatus to be placed in a non-engaging condition comprises automatically displaying a user instruction to refrain from engaging the replaceable module and the operating element of the printing apparatus.

2. The method of claim 1, wherein automatically causing the printing apparatus to be placed in a non-engaging condition additionally comprises automatically causing a barrier to be positioned in an insertion path to block engagement of the replaceable module and the operating element of the printing apparatus.

3. The method of claim 2, wherein automatically causing the printing apparatus to be placed in an engaging condition additionally comprises automatically causing the barrier to be positioned out of the insertion path.

4. A printer comprising:

a printing apparatus for placing an image on a print medium, the printing apparatus including an operating element;

an electrically operated coupler attached to the printing apparatus for verifying identifying information;

a replaceable module that engages the operating element of the printing apparatus;

a module tag affixed to the replaceable module, wherein the module tag contains identifying information relating to the replaceable module, and the module tag is adapted to communicate with the coupler at a time when the replaceable module does not engage the operating element; and an action element responsive to the coupler;

wherein the action element comprises a moveable element motivator for enabling the operating element to engage the replaceable module; and wherein the action element comprises a motor for causing the operating element to engage the replaceable module.

5. A printer comprising:

a printing apparatus for placing an image on a print medium, the printing apparatus including an operating element;

an electrically operated coupler attached to the printing apparatus for verifying identifying information;

a replaceable module that engages the operating element of the printing apparatus;

a module tag affixed to the replaceable module, wherein the module tag contains identifying information relating to the replaceable module, and the module tag is adapted to communicate with the coupler at a time when the replaceable module does not engage the operating element; and an action element responsive to the coupler;

wherein the printing apparatus has an insertion path at an end of which the replaceable module engages the operating element;

wherein the action element comprises a moveable barrier selectively movable from a blocking position in the insertion path to an open position out of the insertion path;

wherein the moveable barrier is in the open position if the coupler verifies identifying information communicated to the coupler; and wherein the movable barrier moves from the open position to the blocking position if the coupler does not verify identifying information communicated to the coupler.

6. A replaceable module for insertion into a printing apparatus, the replaceable module comprising:

a substantially cylindrical replaceable module body;

a memory containing information pertaining to the replaceable module; and a plurality of substantially parallel electrically conductive strips encircling the replacement module body, wherein the conductive strips are adapted to establish a communication link with the printing apparatus when the printing apparatus has not fully engaged the replaceable module;

wherein the conductive strips are connected to the memory to communicate the information in the memory to the printing apparatus through the conductive strips.

7. A method of verifying a replaceable module for a printing apparatus, the method comprising:

directing the replaceable module along an insertion path toward engagement with an operating element of the printing apparatus;

reading module information from the replaceable module before the replaceable module engages the operating element;

comparing the module information with apparatus information stored in the printing apparatus to determine if the module information is compatible with the apparatus information; and automatically taking an action dependent upon the outcome of the comparing step to control whether the replaceable module can engage the operating element;

wherein if the module information is not fully compatible with the apparatus information, automatically displaying a warning on the printing apparatus, wherein the warning calls for user acknowledgement of the warning; and wherein if the warning is displayed, a barrier in the insertion path is removed from the insertion path only if the user acknowledges the warning.

8. The method of claim 7, additionally comprising automatically removing the barrier from the insertion path if the comparing step establishes that the module information is fully compatible with the apparatus information.

* * * * *